US007194953B2

(12) United States Patent
Christel et al.

(10) Patent No.: US 7,194,953 B2
(45) Date of Patent: Mar. 27, 2007

(54) DRESSING ON A CYLINDER OR A TRANSFER CYLINDER AS WELL AS PRINTING UNITS OF A PRINTING PRESS

(75) Inventors: Ralf Christel, Aschbach (DE); Oliver Frank Hahn, Veitshöchheim (DE); Karl Erich Albert Schaschek, Thüngen (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 37 days.

(21) Appl. No.: 10/510,711

(22) PCT Filed: Apr. 9, 2003

(86) PCT No.: PCT/DE03/01157

§ 371 (c)(1),
(2), (4) Date: Oct. 18, 2004

(87) PCT Pub. No.: WO03/086774

PCT Pub. Date: Oct. 23, 2003

(65) Prior Publication Data

US 2005/0166775 A1 Aug. 4, 2005

(30) Foreign Application Priority Data

Apr. 18, 2002 (DE) ..... 102 17 402.4
Aug. 14, 2002 (DE) ..... 102 37 205.5

(51) Int. Cl.
*B41F 5/00* (2006.01)

(52) U.S. Cl. ..... 101/216; 101/217; 428/221

(58) Field of Classification Search ..... 101/216, 101/415.1, 217; 428/221, 297
See application file for complete search history.

(56) References Cited

U.S. PATENT DOCUMENTS

| | | | | |
|---|---|---|---|---|
| 2,944,482 | A | 7/1960 | Aller | |
| 3,147,698 | A | 9/1964 | Ross | |
| 3,395,638 | A | 8/1968 | Kirkus et al. | |
| 3,652,376 | A * | 3/1972 | Bowden, III | 442/104 |
| 3,887,750 | A * | 6/1975 | Duckett et al. | 442/194 |
| 4,350,735 | A * | 9/1982 | Saitoh | 428/328 |
| 4,537,129 | A * | 8/1985 | Heinemann et al. | 101/415.1 |
| 4,817,527 | A * | 4/1989 | Wouch et al. | 101/389.1 |

(Continued)

FOREIGN PATENT DOCUMENTS

| | | |
|---|---|---|
| CH | 426 903 | 6/1967 |

(Continued)

OTHER PUBLICATIONS

Juhasz, Kevin; Heidelberg Introduces Triple-Width Newspaper Press; Newspapers & Technology; Dec. 2000; 4 pp.; Germany.*

*Primary Examiner*—Ren Yan
*Assistant Examiner*—Matthew Marini
(74) *Attorney, Agent, or Firm*—Jones Tullar Cooper, PC

(57) ABSTRACT

A blanket is located on an outer surface of a roller, such as printing unit roller. The blanket has an elastic and/or a compressive layer with a surface pressure that depends on the degree of the impression. The layer is selected so that a depending of the surface pressure on the impression has, at least in some areas, a slope of less than 700 (N/cm$^2$)/mm.

10 Claims, 5 Drawing Sheets

U.S. PATENT DOCUMENTS

| | | | | | |
|---|---|---|---|---|---|
| 4,870,901 | A | * | 10/1989 | Norkus | 101/415.1 |
| 5,304,267 | A | | 4/1994 | Vrotacoe et al. | |
| 5,323,702 | A | | 6/1994 | Vrotacoe et al. | |
| 5,350,623 | A | * | 9/1994 | Derrick | 428/217 |
| 5,357,863 | A | * | 10/1994 | McLean et al. | 101/389.1 |
| 5,429,048 | A | | 7/1995 | Gaffney et al. | |
| 5,440,981 | A | | 8/1995 | Vrotacoe et al. | |
| 5,553,541 | A | | 9/1996 | Vrotacoe et al. | |
| 5,749,298 | A | * | 5/1998 | Castelli et al. | 101/415.1 |
| 5,768,990 | A | | 6/1998 | Vrotacoe et al. | |
| 5,884,559 | A | | 3/1999 | Okubo et al. | |
| 5,907,997 | A | | 6/1999 | Jackson et al. | |
| 6,231,954 | B1 | | 5/2001 | Yoshida et al. | |
| 6,374,734 | B1 | | 4/2002 | Gaffney et al. | |
| 6,386,100 | B1 | | 5/2002 | Gaffney et al. | |
| 6,408,747 | B2 | | 6/2002 | Koppelkamm et al. | |
| 6,782,820 | B1 | * | 8/2004 | Okubo et al. | 101/375 |
| 6,935,995 | B2 | | 8/2005 | Siebert et al. | |
| 2002/0062753 | A1 | * | 5/2002 | Herrmann | 101/376 |
| 2002/0078840 | A1 | | 6/2002 | Gaffney et al. | |
| 2002/0189470 | A1 | | 12/2002 | Holm | |
| 2003/0033948 | A1 | * | 2/2003 | Buono et al. | 101/395 |
| 2004/0107849 | A1 | | 6/2004 | Christel et al. | |
| 2004/0144268 | A1 | | 7/2004 | Christel et al. | |
| 2005/0034615 | A1 | | 2/2005 | Holm et al. | |
| 2005/0166775 | A1 | | 8/2005 | Christel et al. | |

FOREIGN PATENT DOCUMENTS

| | | |
|---|---|---|
| CH | 467 169 | 2/1969 |
| DE | 1 085 171 | 7/1960 |
| DE | 1 940 852 | 2/1970 |
| DE | 2 033 249 | 1/1971 |
| DE | 24 33 748 | 1/1976 |
| DE | 691 07 317 | 9/1995 |
| DE | 198 03 809 A 1 | 8/1999 |
| DE | 199 16 257 A 1 | 11/1999 |
| DE | 100 00 401 A 1 | 7/2001 |
| DE | 101 29 107 A41 | 1/2003 |
| DE | 102 37 205 A 1 | 11/2003 |
| EP | 0 514 344 | 11/1992 |
| EP | 0 546 535 | 6/1993 |
| WO | WO 01/39974 | 6/2001 |
| WO | WO 02/0811213 A2 | 10/2002 |

* cited by examiner

DRESSING ON A CYLINDER OR A TRANSFER CYLINDER AS WELL AS PRINTING UNITS OF A PRINTING PRESS

CROSS-REFERENCE TO RELATED APPLICATIONS

This patent application is the U.S. National Phase, under 35 U.S.C. 371, of PCT/DE03/1157, filed Apr. 9, 2003; published as WO 03/08774A2 and A3 on Oct. 23, 2003 and claiming priority to DE 102 17 402.4 filed Apr. 18, 2002, and to DE 102 37 205.5 filed Aug. 14, 2002, the disclosures of which are expressly incorporated herein by reference.

FIELD OF THE INVENTION

The present invention is directed to a dressing on a cylinder, or on a transfer cylinder, as well as printing units of a printing press with the cylinder. At least one of the cylinders has a dressing having an elastic and/or compressible layer.

BACKGROUND OF THE INVENTION

A printing blanket is known from DE 691 07 317 T2, which consists of several layers and, in an extreme case, has a total thickness of from 0.55 to 3.65 mm. The modulus of elasticity of the several layers of cellular rubber lies between 0.2 to 50 MPa, or between 0.1 to 25 MPa. Because of the special structure of the printing blanket, and because of the properties of the several layers, a printing blanket is obtained which, when indented, does not tend towards lateral shifting or protuberances.

DE 19 40 852 A1 discloses a printing blanket for offset printing, which blanket has a total thickness of almost 1.9 mm. A modulus of shearing, in the form of tension at 0.25 mm deformation in case of a thickness of the printing blanket, is stated to be approximately 4.6, 1.9 or 8.23 kg/cm$^2$. The goal, in this case, is to achieve a quick recovery after an indentation, as well as to achieve a narrow thickness tolerance.

CH 426 903 discloses an offset printing blanket in which customary indentation depths of 0 to 0.1 mm exist. An increase of the indentation from 0.05 to 0.1 mm requires, or has, at a result, a change in the surface pressure of approximately 20.6 N/cm$^2$. This means that, in this range of indentation depth and with surface pressures of up to approximately 40 N/cm$^2$, there would be a linearized "spring characteristic" with a rise of approximately 412 N/cm$^2$/mm.

WO 01/399 74 A2 discloses printing units with two cylinders, which two cylinders work together in the placed-together position. A forme cylinder has an opening, in the area of its surface, in the form of an axially extending groove for use in fastening one end of one or of several printing formes. A transfer cylinder, which acts together with the forme cylinder in a contact zone, has an elastic rubber blanket in the area of its surface.

For the transfer of ink and other fluids between two cylinders of a printing press, recourse is regularly had to the material combination of hard-soft, for example in an inking and/or dampening unit, as well as in the practice of an offset printing method between printing group cylinders. The surface pressure required for ink transfer between the two cylinders is achieved by making an indentation in a resilient, such as, for example, an elastomeric layer, which may be a soft elastomeric cover/dressing, rubber blanket, or metal printing blanket, sleeve, by a cooperating cylinder with a surface which is incompressible and which is also inelastic, to a large degree.

Essential criteria for the uniform transfer of the fluid between the cylinders are a contact pressure, which is preset within narrow margins, as well as the constancy of the contact pressure. If fluctuations occur in the spacing distance between the cooperating cylinders, for example because of cylinder out-of-roundness or because of vibrations induced by interferences with the roll-off of the cylinders, the contact force, or the surface pressure, changes, and thus the transfer behavior of the fluid also changes. At locations with interrupted or with reduced contact, for example at the location of the plate or rubber blanket tensioning groove, the surface pressure, for example, changes periodically. This periodic change in surface pressure results in a vibration excitation of the printing cylinders. In the field of printing technology, this change in surface pressure is expressed by changes in the ink intensity in the resulting printed image. If, for example, the contact pressure has been permanently changed through exterior conditions such as longer wave interference, the danger of too faint or of too color-intensive printed products exists until the time of correction. These products are typically considered as waste products. If the contact pressure is dynamically changed because of vibrations, such as shorter wave interference, this change in contact pressure is expressed by the formation of visible stripes in the printed product.

SUMMARY OF THE INVENTION

The object of the present invention is directed to producing a dressing for, or on a cylinder, the arrangement of this cylinder in relation to a second cylinder, as well as to printing units of a printing press.

In accordance with the invention, this object is attained by the provision of a dressing on a surface on a cylinder having an elastic or compressible layer with a surface pressure as a function of an indentation. One of the cylinders, in a printing unit of two cylinders, and which has the elastic or compressible layer is a transfer cylinder. A contact width between the transfer cylinder and its cooperating cylinder is at least 10 mm and is at least 5% of the effective cylinder diameter. The indentation caused on the transfer cylinder surface may be at least 0.18 mm. At least one of the cylinders may have a dressing end receiving groove which has a width, with respect to the width of the contact zone, that is at most 1 to 3.

The advantages to be gained by the present invention reside, in particular, in that a reduced sensitivity to changes, or to fluctuations, in the contact pressure or surface pressure, is achieved, and that because of this, a high quality of the printed product can be achieved in a simpler manner and can be maintained. By the use of special dressings, by an optimized layout of the cylinders, as well as by their arrangement, it is possible to reduce the effects of any cylinder movements on ink transfer. In a particularly advantageous embodiment, with cylinders having narrow places of interrupted, or of reduced contact, the vibration excitation itself is moreover reduced.

By the embodiment of the dressing and/or by the arrangement of the cylinders in relation to each other, the transfer of the fluid between the two is considerably less affected. The same applies, for example, to interferences that are induced by changes in the process, such a changing speed, changing thickness of the material; of a web, bringing further cylinders into or out of contact to spacing deviations which occur as a result of inaccuracies in the course of making contact, such as stops, finite stiffness, or manufacturing tolerances; as well as to changes in the dressing thickness because of wear; i.e. longer wave vibrations and/or incomplete restoration after passing through the nip location; shorter wave or longer wave vibrations.

This is achieved, in particular, in that the dressing is configured in such a way, or the cylinder is produced with an appropriate dressing, that a dependence of the resulting surface pressure or contact pressure, in the course of a variation of the indentation, extends considerably flatter than is customary. A spring characteristic, i.e. an increase in dependence of the surface or contact pressure from the indentation, advantageously lies, at least in an advantageous range, for the indentation in the print-on position of at the most 700 ($N/cm^2$)/mm.

An advantageous range of a relative indentation of the dressing, in the operating state or in the print-on position, lies between 5% and 10%, for example. However, ranges for setting the relative indentation, which ranges differ as a function of the two cylinders working together, can be preferred for achieving optimal results in view of the required transfer of the fluids, along with a simultaneously small effect of fluctuations.

In an advantageous embodiment of the present invention, the surface or contact pressure, in the print-on position, varies, at most, within a range of between 60 and 220 $N/cm^2$. Or for various sub-ranges for fluids, such as, for example, printing inks, having greatly different rheological properties, and/or different printing methods, in particular in these ranges, or sub-ranges, the curve should meet the requirements made on the rise.

Up to the present, the width of the contact zone, which is being created by the pressure of the cylinders against each other in the nip, has, as a rule, been kept as narrow as possible. A widened nip location results in a higher linear force, and therefore results in increased static bending. However, this disadvantage is compensated for by the dressing in accordance with the present invention, or the cylinder arrangement. In an advantageous embodiment, a width of the nip location is, for example, at least 10 mm, and in particular, is greater than or equal to 12 mm. An advantageous surface or contact pressure can be achieved with this nip width.

For the case where a vibration is induced by an interference, such as, for example, by an interruption, on one of the surfaces of the cylinders which work together directly, or via a web, it is possible, by the construction of the dressing and/or by the arrangement of the cylinders in relation to each other, to also reduce the excitation of this vibration, or to reduce its amplitude. This applies, in particular, to an embodiment of the present invention wherein a width of the cylinder surface interruption, in the circumferential direction, has, at most, a ratio of 1:3 with respect to the width of the nip, or the imprint strip, caused by the indentation.

In general, the dressing, or the cylinder layer, permits the use of slimmer, or also longer print cylinders. These are cylinders in which a length of the cylinders is large in comparison with the diameter of the cylinder.

BRIEF DESCRIPTION OF THE DRAWINGS

Preferred embodiments of the present invention are represented in the drawings and will be explained in greater detail in what follows.

Shown are in.

DESCRIPTION OF THE PREFERRED EMBODIMENT

Figure 1:
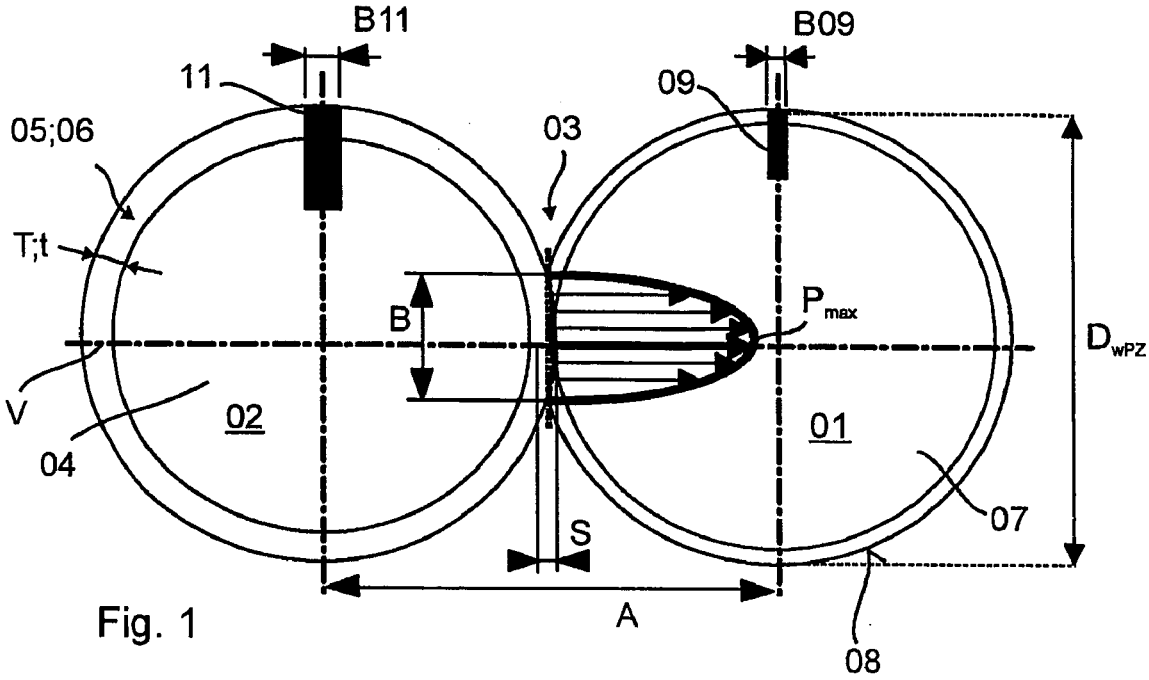
FIG. 1, a schematic representation of the line forces between two cylinders while using a conventional dressing, in FIG. 2, a schematic representation of the line forces between two cylinders while using a dressing in accordance with the present invention, in FIG. 3, the measured surface pressure in a variation of the indentation, in FIG. 4, a first preferred embodiment of a printing unit in accordance with the present invention, in FIG. 5, a second preferred embodiment of a printing unit, in FIG. 6, a third preferred embodiment of a printing unit, in FIG. 7, a fourth preferred embodiment of a printing unit, and in FIG. 8, a schematic representation of a dressing with a support layer in accordance with the present invention.
Figure 2:
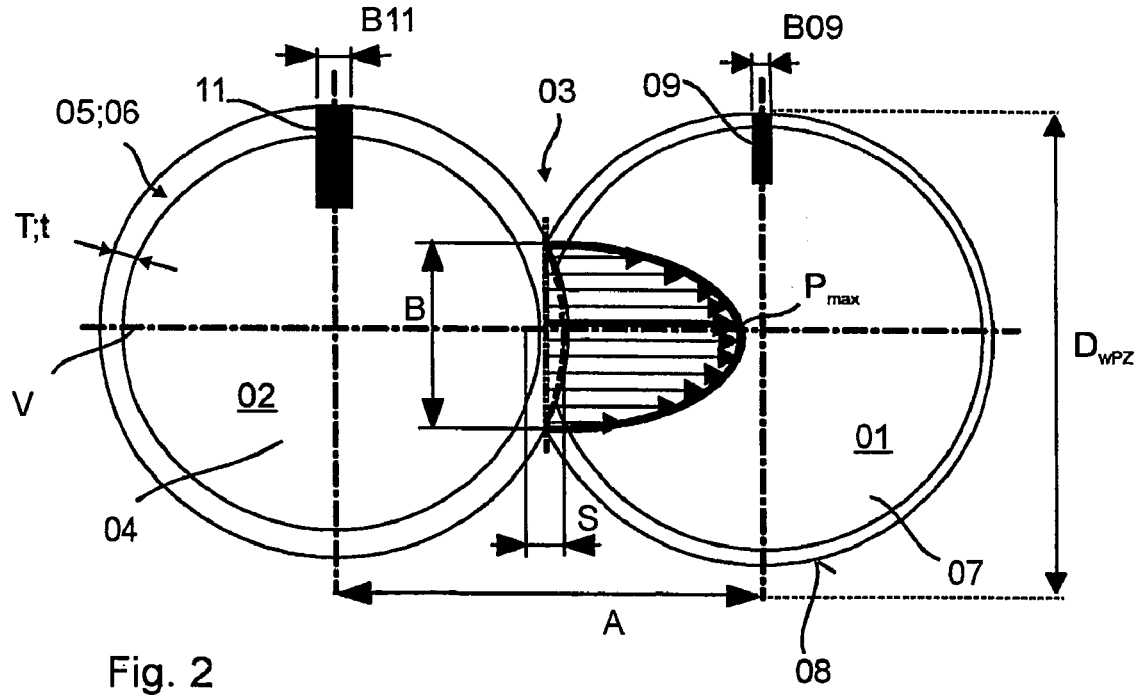
Figure 8:
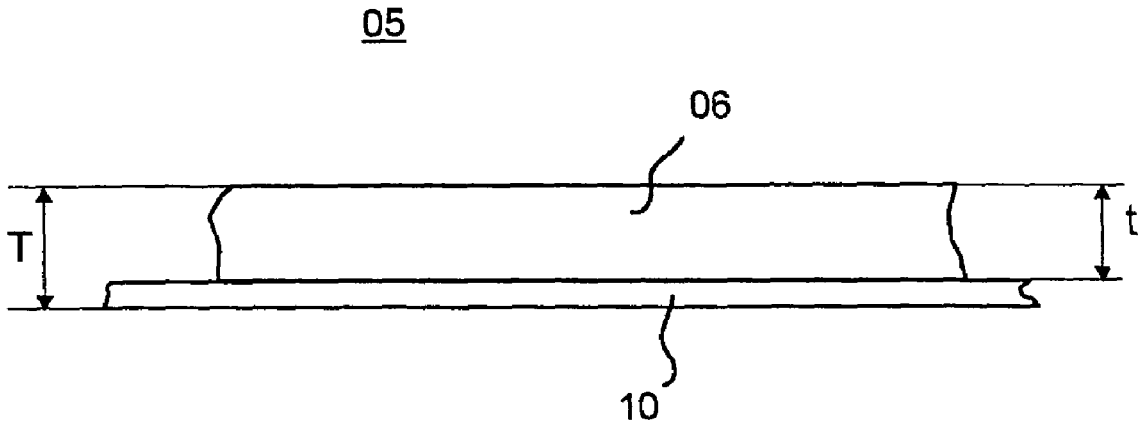

Referring initially to FIGS. 1 and 2, a machine, for example a printing press, has cylinders 01, 02, which roll off on each other and which together form a nip location 03, such as, for example, a cylinder gap 03. In the case of a printing press, these cylinder 01, 02 can be cylinders of an inking unit, a varnishing unit, or can be cylinders 01, 02 of a printing unit. In the preferred embodiment of the present invention, that is represented in FIG. 1, the cylinders 01, 02 represent a forme cylinder 01 of an effective diameter $D_{wPZ}$, and a transfer cylinder 02 of an offset printing unit. One of the cylinders 01, 02, for example the transfer cylinder 02, has a dressing 05 or a cover 05 with a soft elastomeric layer 06 of a thickness "t" that is on the surface of a largely incompressible, inelastic cylinder core 04 of a diameter $D_{GZK}$. The total thickness "T" of the dressing 05 is composed of, for example, the thickness "t" of the soft, elastomeric layer 06, as well as a thickness of a support layer 10, which support layer 10 is possibly connected with the layer 06 and which is substantially incompressible and inelastic, which support layer 10 may be, for example, a metal plate, shown, by way of example, in FIG. 8. If the dressing 05 does not have an additional support layer 10, the thickness "t" corresponds to the total thickness "T". The layer 06 can be built up as an inhomogeneous layer 06 of several layers, which together have the required properties for the layer 06. Together, the core 04 and the dressing or cover 05, constitute an effective diameter $Ds24_{wGZ}$ of the transfer cylinder 02. The effective diameter $D_{wGZ}$ of the transfer cylinder 02 is determined at the point of contact of the transfer cylinder 02 with the surface of the forme cylinder 01 which surface of the forme cylinder 01 is effective for the roll-off, and which possibly includes a dressing 08, for example a printing forme 08, applied to the surface of a forme cylinder base body 07. The cylinder 01 with the hard surface can also be embodied as a counter-pressure cylinder 01, which is working together with the transfer cylinder 02. The specific embodiment of the layer 06, as is explained in what follows, is not tied to the embodiments of the cylinders 01, 02 as transfer and forme cylinders 01, 02, or to an embodiment of the cylinder 01 with a printing form 08.

As a function of the spacing between the two cylinders 01, 02, i.e. as a function of their axial spacing distance A, the largely incompressible inelastic surface of the forme cylinder 01 "dips" or intrudes or penetrates into the soft layer 06 of the dressing or cover 05 on the transfer cylinder 04 and causes an indentation S in that soft or resilient layer 06, in comparison to the undisturbed course of the layer 06. Because of the restoring forces, a fluctuating or a changing indentation S, as a rule, leads to a fluctuating or to a changing surface or contact pressure P in the cylinder gap 03, and causes the previously discussed problems in the quality of the ink transfer, and, in the, end, causes problems in the quality of the printed product.

A profile of a surface or contact pressure P in the nip 03 between the two cylinders 01 and 02, using a conventional dressing, is schematically represented in FIG. 1. The surface pressure P extends over the entire area of the contact zone wherein, at rest, at a height of a connecting plane V between the axes of rotation of the two cylinders, the surface or contact pressure P reaches a maximum surface pressure $P_{max}$. During production, the location of the area of maximum pressure shifts toward the incoming gap side as a result of the viscous force portion. In a projection onto a plane E, which plane E extends perpendicularly with respect to the connection plane V, the contact zone, and therefore the profile, has a width B. The maximum surface pressure $P_{max}$ is ultimately responsible for the ink distribution, and must be set accordingly.

In comparison with FIG. 1, FIG. 2 schematically shows the profile of the surface or contact pressure P in the case, in accordance with the present invention, of a greater indentation S, which simultaneously causes a widening of the width B. If it is now intended to achieve the maximum surface or contact pressure $P_{max}$ in spite of this increased width of the contact zone is, the integration of the surface or contact pressure P over the entire width B leads to an increase of a force between the two cylinders 01, 02.

The absolute size of the surface pressure P in the cylinder gap 03, as well as its fluctuation when the indentation S varies, is substantially determined by a spring characteristic of the layer 06 used, or of the dressing 05 in which the layer 06 is used. The spring characteristic represents the surface or contact pressure P as a function of the indentation S. Some spring characteristics of customary dressings 05, and in particular of printing blankets 05 with an appropriate layer 06, are represented, by way of example, in FIG. 3. The values have been determined in the laboratory at a quasi-static die test stand. They should be transferred, in a suitable manner, to values determined in another way.

Figure 3:
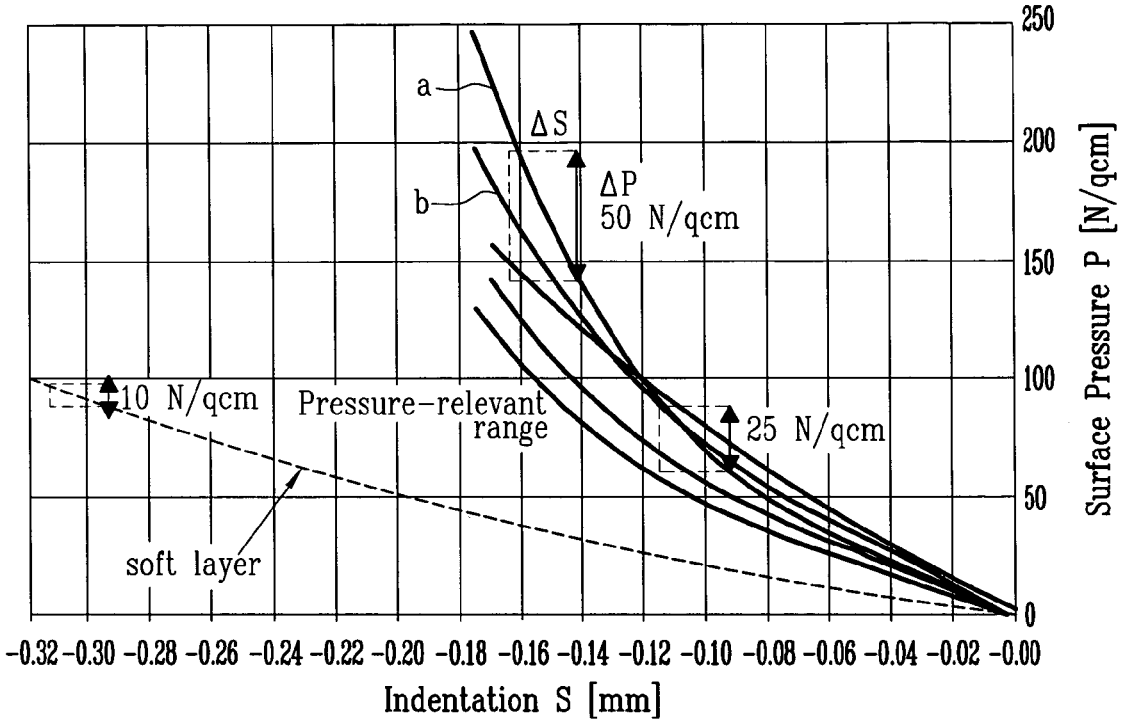

It can be seen in FIG. 3, that a rise $\Delta P/\Delta S$ of the spring characteristic determines the fluctuation in the surface pressure P during the change of the indentation S, for example in the case of a vibration. With a variation $\Delta S$ of the indentation around a mean indentation value S, the size of a fluctuation $\Delta P$ of the required maximum surface pressure $P_{max}$ in the cylinder gap 03 around the mean surface pressure P is approximately proportional to the rise $\Delta P/\Delta S$ of the spring characteristic at the location S. Thus, in connection with a dressing "a", as depicted in FIG. 3, for example, a reduction of the indentation S from −0.16 mm to −0.14 mm acts on the surface pressure P in the form of a reduction by approximately 50 N/cm$^2$, and a reduction of the indentation S from −0.11 mm to −0.09 mm acts on the surface tension in the form of a reduction by approximately 25 N/cm$^2$. A dressing "b" has a lesser rise, as also depicted in FIG. 3.

Dressings 05, which either as a whole, or whose layers 06 as such, have such a large rise $\Delta P/\Delta S$, in particular in the range of the required maximum surface pressure $P_{max}$ in the relevant pressure range, are called "hard" in what follows, those with a small rise $\Delta P/\Delta S$ are called "soft".

The dressing 05, or the layer 06, in accordance with the present invention are embodied as a "soft" dressing 05 or as a "soft" layer 06. In contrast to a "hard" dressing 05, or to a "hard" layer 06, identical relative movements of the cylinders 01, 02, or of the change of the distance A, therefore lead to a lesser change of the surface or contact pressure P in case of a soft dressing 05, and therefore lead to, or result in a reduction of the fluctuations in the ink transfer. Thus, the soft dressing 05 of the present invention results in lesser sensitivity of the printing process to vibrations and/or to deviations of spacings from a nominal value. With fewer changes in the surface pressure P because of relative movements of the cylinders 01, 02, with the use of soft dressings 05, or with dressings 05 with a soft layer 06, vibration strips in the printed product, for example, only become visible at larger vibration amplitudes.

In an advantageous embodiment of the present invention, the surface, or contact pressure varies, at most, within a range of between 60 and 220 N/cm$^2$. In connection with fluids, for example with printing inks with greatly different rheologic properties, different ranges within the above mentioned range of the surface pressure can be preferable. Thus, the range of the surface pressure, in connection with wet offset printing; i.e. with printing using ink and dampening agent, varies between 60 and 120 N/cm$^2$, and in particular between 80 to 100 N/cm$^2$, for example, while in case of dry offset printing, with no dampening agent, and with only the application of ink to the forme cylinder the range of the surface or contact pressure varies between 100 and 220 N/m$^2$, and in particular between 120 to 180 N/cm$^2$, for example. In these ranges, in particular, the rise should meet the requirements for a rise.

The print-relevant range for the surface or contact pressure $P_{max}$ advantageously lies between 60 and 220 N/cm$^2$. For fluids, for example with printing inks with greatly differing rheologic properties, different ranges within the above mentioned range of the surface pressure can be preferred. Thus, the range for wet offset printing varies, for example, between 60 and 120 N/cm$^2$, and in particular from 80 to 100 N/cm$^2$. This is represented in FIG. 3. In case of dry offset printings, the range varies, for example, between 100 and 220 N/cm$^2$, and in particular from 120 to 180 N/cm$^2$. Thus, in an advantageous embodiment, a soft dressing 05, ]or its soft layer 06, has, at least in the range of 80 to 100 N/cm$^2$, a rise $\Delta P/\Delta S$ of, for example, $\Delta P/\Delta S<700$ (N/cm$^2$)/mm, and in particular $\Delta P/\Delta S<500$ (N/cm$^2$)/mm. In the respective range for the surface or contact pressure P, the rise $\Delta P/\Delta S$ should be smaller, by at least a factor of two, than is customary currently for dressings 05 in offset printing.

As schematically indicated in FIG. 2, in an advantageous embodiment of the present invention, the layer 06 has a greater thickness "t", or the dressing 05 has a greater total thickness "T", than has been previously customary. The thickness "t" of the layer 06, which is functional in respect to elasticity or compressibility, is for example 3.0 to 6.3 mm, and in particular is from 3.7 to 5.7 mm thick. Added to this elastic layer 06 is the thickness of one or several support layers 10, which are substantially incompressible and inelastic, and which are possibly connected with the layer 06, if desired, on the side of layer 06 facing the core 07, which support layers 10 are connected with the layer 06 for the purpose of providing stability of shape and/or dimensions. This support layer 10, or these support layers 10, which is/are functionally effective for the shape stability, can also be arranged between the "soft" layers 06. For example, support layer 10 can be embodied as sheet metal, in particular of high-grade steel, of a thickness of approximately 0.1 to 0.3 mm. If the support layer 10 is in the form of a woven material, it can be 0.1 to 0.6 mm thick, depending on the embodiment of the dressing 05. In the case of several soft layers 06, the thickness "t" of the soft layer 06 relates to a sum of the possibly several "partial layers", which are functionally responsible for the above described characteristic of dependence of surface pressure/indentation, and to elasticity or compressibility. In that case, a dressing 05 with a soft layer 06, together with a support layer or layers 10, has a total thickness T of 3.5 to 6.5 mm, and in particular of 3.9 to 5.9 mm.

The "soft" dressing 05 or the "soft" layer 06 is preferably operated at a greater indentation S in comparison with customary or known indentations S, as schematically represented in FIG. 2 as comparison with FIG. 1, i.e. the two cylinders 01, 02 are put closer together in relation to their respectively effective, but undisturbed diameters $D_{wGz}$, $D_{wPZ}$. Because of this, an optimal maximum surface pressure $P_{max}$ is achieved in spite of a reduced rise $\Delta P/\Delta S$. In an advantageous embodiment, the placement of the cylinders 01, 02 against each other is performed in such a way that the indentation S is at least 0.18 mm, is, for example, between 0.18 to 0.60 mm, and in particular is from 0.25 to 0.50 mm.

A relative indentation S*, i.e. the indentation S in relation to the thickness "t" of the layer 06, without taking into consideration the particular embodiment of the cylinders 01, 02, lies, for example, between 5% and 10%, and in particular lies between 6% and 8%.

In an advantageous embodiment, a width B of the contact zone, in a projection perpendicularly to a connecting plane V of their axes of rotation, resulting from the indentation S of the layer 06, is at least 5% of the undisturbed effective diameter $D_{wGZ}$ of the cylinder 02 with the layer 06.

As described above, the embodiment and/or the arrangement of the "soft" dressing 05 is particularly advantageous, if one of the two cooperating cylinders 01, 02, or even if both of the cylinders have an interference 09, 11 on their effective surface, which affects the rolling-off. This interference 09, 11, in the form of an interruption 09, 11, can be an axially extending joint of two ends of one or of several dressings 05, 08. In particular, the interference 09, 11 can also be caused by an axially extending groove 09, 11 for use in fastening of the ends of one or of several dressings 05, 08. This groove 09, 11 has an opening toward the cylinder surface, through which opening the ends have been conducted. In its interior, the groove 09, 11 can have a device for clamping and/or tensioning of the dressing 05, 08, or the dressings 05, 08.

In the course of cylinder 01 rolling over the groove 09, 11, or the grooves 09, 11 of cylinder 02, vibrations are induced. If, viewed in the circumferential direction, the width B09, B11 of the groove 09, 11 is greater than the width B of the contact zone, a vibration, with an increased amplitude, is induced during the passage of the groove 09, 11 since, because of the above mentioned greater width B of the contact zone, a larger linear force acts between the two cylinders 01, 02. Yet, because of the greater linear force, the increase of the vibration amplitudes is less than the reduction of the sensitivity to vibrations because of the softness of the layer 06, so that an overall reduction of the sensitivity to vibrations results.

It is of particular advantage to select the width B09, B11 of the grooves 09, 11 to be less than the width B of the contact zone. In this case, at least areas of the cooperatively acting surfaces are alway supported on each other in the contact zone. In addition, a reduction of the size and a flatter course, or a widening of the pulse, results for the force of the beating excitation. Therefore, with narrow grooves 09, 11, the use of softer dressings 05, or softer layers 06, leads to a weakening and to a chronological lengthening of the groove beat.

In the case of the transfer cylinder 02, the ends of a metal printing blanket can be arranged in the groove 11. In this case, the layer 06 has been applied to a dimensionally stable support, for example to a thin sheet metal plate, whose beveled ends are arranged in the groove 11. The groove 11 can be configured to be extremely narrow, for example having a width less than, or equal to 5 mm, and in particular having a width less than or equal to 3 mm. Also, in the case of the forme cylinder 01, the groove 09 is structured, in an advantageous embodiment, with a width in the circumferential direction of less than or equal to 5 mm, and in particular with a width of less than or equal to 3 mm.

Conversely, because of the contact zone, or the imprint strip, which is larger in comparison with prior art contact zones, the permissible ratio B09:B, or B11:B is reduced. An embodiment is of particular advantage, wherein the width B09, B11 of the groove 09, 11, in the area of its opening, or mouth, toward the surface of the core 04, or the base body 07, has, at most, a ratio of 1:3 in the circumferential direction in relation to the width B of the contact zone or the imprint strip formed by the indentation.

Preferably, the soft layer 06 has a reduced damping constant in comparison with customarily employed materials. In spite of higher loading and release speeds, occurring during roll-of because of the larger indentation S, no increased flexing heat is generated. Also, the layer 06 must be embodied in such a way that a sufficiently rapid restoration, or spring-back, into the initial position, takes place following the passage through the cylinder gap 03 so that, for example, the initial thickness is again present in the course of contact with an inking roller or with a further cylinder.

Figure 4:
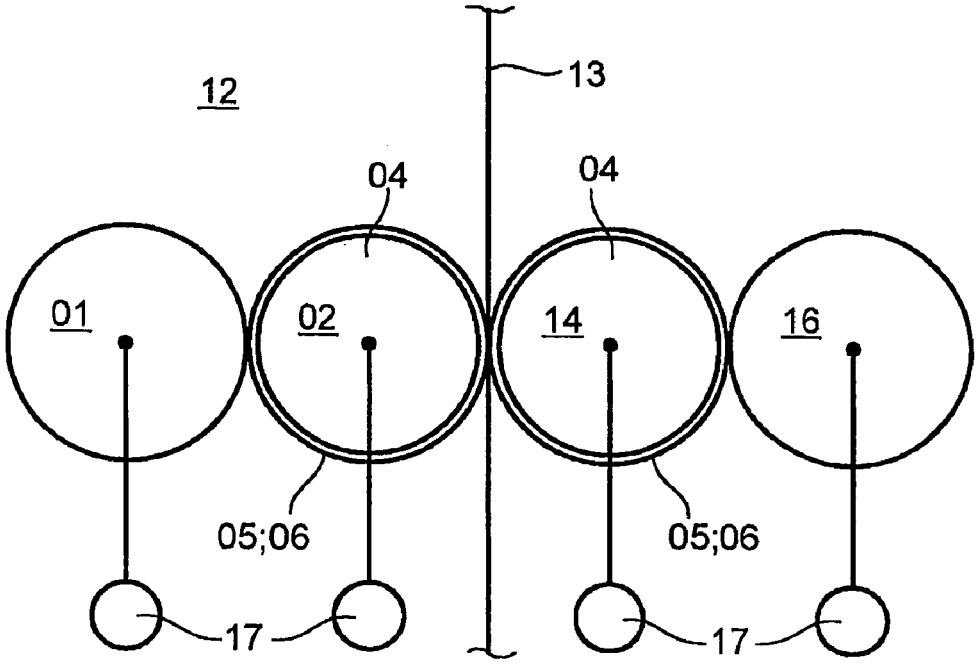
Figure 5:
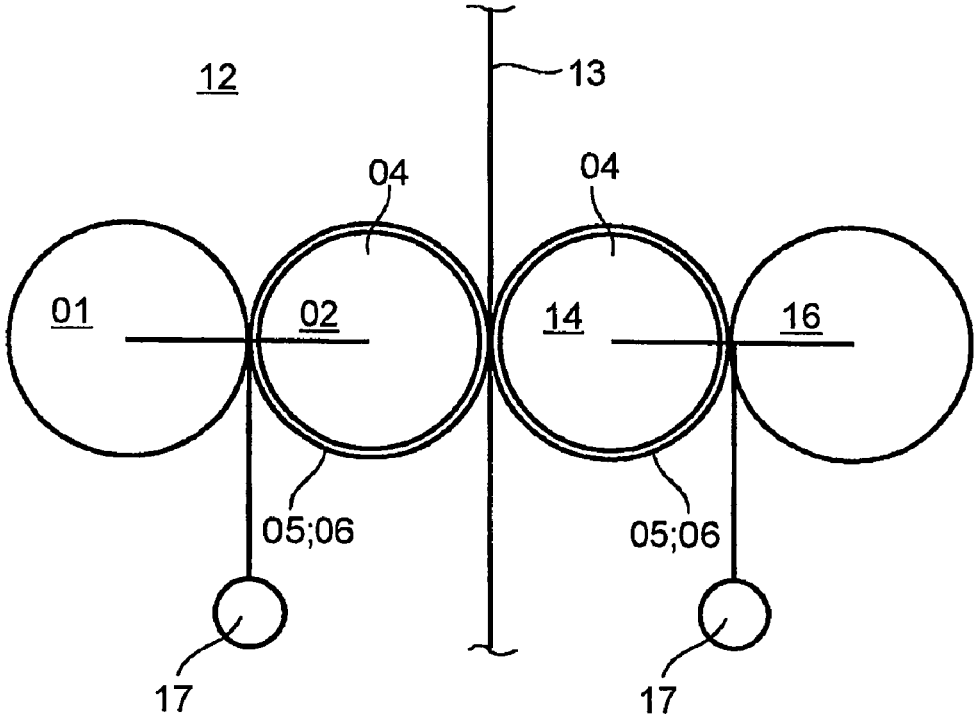

A printing unit 12, which is configured in an advantageous manner with the layer 06 and which is embodied as a so-called double printing unit 12, is represented in FIGS. 4 and 5. The transfer cylinder 02, which is assigned to the forme cylinder 01, and which form a first cylinder pair 01, 02, cooperates with a counter-pressure cylinder 14, that is also embodied as a transfer cylinder 14, and which is also assigned to a forme cylinder 16, via a material 13 to be imprinted, for example via a web 13. All four cylinders 01, 02, 14, 16 are each driven, mechanically independent of each other, by different drive motors 17, as seen in. In a modification, the forme and transfer cylinders 01, 02, 14, 16 are coupled in pairs and each pair is driven by a paired drive motor 17, either at the forme cylinder 01, 16, at the transfer cylinder 02, 14, or parallel to the cylinders, all as seen in.

In a first preferred embodiment, the forme cylinders 01, 16 and the transfer cylinders 02, 14 are embodied as cylinders 01, 02, 14, 16 of double circumference, i.e. as cylinders each with a circumference of substantially two upright printed pages, in particular two newspaper pages. The cylinders are configured with effective diameters $D_{wGZ}$, $D_{wPZ}$ between 260 to 400 mm, and in particular between 280 to 360 mm. On the surface of the core 04, each of the transfer cylinders 02, 14 has at least one dressing 05 of a total thickness T of between 3.5 to 6.5 mm, and in particular between 3.9 to 5.9 mm. The rise $\Delta P/\Delta S$ of the spring characteristic, at least in the print-relevant range, as discussed above, lies below 700 $(N/cm^2)$/mm, and in particular lies below 500 $(N/cm^2)$/mm. The forme and transfer cylinders 01, 02, 14, 16 have been placed against each other in pairs in such a way that the width B of the contact zone between the forme and transfer cylinders 01, 02, 14, 16, in the position in which they are placed against each other, is from 14 to 25 mm, and in particular is from 17 to 21 mm. By the use of this configuration, the sensitivity of the printed product to vibrations and to inexact placement of the cylinders against each other has been minimized to a large extent. The individual drive mechanisms, in the form of drive motors 17, aid this by the mechanical uncoupling.

In a second preferred embodiment of the present invention, which is not specifically represented, the forme cylinders 01, 16 and the transfer cylinder 02, 14 are embodied as cylinders 01, 02, 14, 16 each of single circumference, i.e. as cylinders each with a circumference of substantially one upright printed page, and in particular of one newspaper page. These cylinders are structured with effective diameters $D_{wGZ}$, $D_{wPZ}$ of between 150 to 190 mm. On the surface of the core 04, the transfer cylinder 02, 14 has at least one dressing 05 of a total thickness T of from 3.5 to 6.5 mm, and in particular of from 3.9 to 5.9 mm. The rise ΔP/ΔS of the spring characteristic, at least in the print-relevant range, as discussed above, again lies below 700 (N/cm$^2$)/mm, and in particular lies below 500 (N/cm$^2$)/mm. The forme and transfer cylinders 01, 02, 14, 16 have been placed against each other in pairs in such a way that the width B of the contact zone between the forme and transfer cylinders 01, 02, 14, 16, in the position in which they are placed against each other, is from 10 to 18 mm, and in particular is from 12 to 15 mm.

In a third preferred embodiment, which is also not depicted, the forme cylinders 01, 16 are embodied as cylinders 01, 16 of single circumference with effective diameters $D_{wPZ}$ of between 150 and 190 mm, and the transfer cylinders 02, 14 are embodied as cylinders 02, 14 of double circumference with effective diameters $D^{wGZ}$ of between 260 to 400 mm, and in particular of from 280 to 350 mm. The transfer cylinders 02, 14 each have at least one dressing 05 of a total thickness T of from 3.5 to 6.5 mm, and in particular from 3.9 to 5.9 mm, on the surface of the core 04. The rise ΔP/ΔS of the spring characteristic, at least in the print-relevant range, as discussed above, again lies below 700 (N/cm$^2$)/mm, and in particular lies below 500 (N/cm$^2$)/mm. The forme and transfer cylinders 01, 02, 14, 16 have been placed against each other in pairs in such a way that the width B of the contact zone between the forme and transfer cylinders 01, 02, 14, 16, in the position in which they are placed against each other is, from 12 to 20 mm, and in particular is from 15 to 19 mm.

In a third preferred embodiment, which is also not depicted, the forme cylinders 01, 16 are embodied as cylinders 01, 16 of single circumference with effective diameters $D_{wPZ}$ of between 150 and 190 mm, and the transfer cylinders 02, 14 are embodied as cylinders 02, 14 of double circumference with effective diameters $D_{wGZ}$ of between 260 to 400 mm, and in particular of from 280 to 350 mm. The transfer cylinders 02, 14 each have at least one dressing 05 of a total thickness T of from 3.5 to 6.5 mm, and in particular from 3.9 to 5.9 mm, on the surface of the core 04. The rise ΔP/ΔS of the spring characteristic, at least in the print-relevant range, as discussed above, again lies below 700 (Ncm$^2$)/mm, and in particular lies below 500 (Ncm$^2$)/mm. The forme and transfer cylinders 01, 02, 14, 16 have been placed against each other in pairs in such a way that the width B of the contact zone between the forme and transfer cylinders 01, 02, 14, 16, in the position in which they are placed against each other is, from 12 to 20 mm, and in particular is from 15 to 19 mm.

Figure 6:
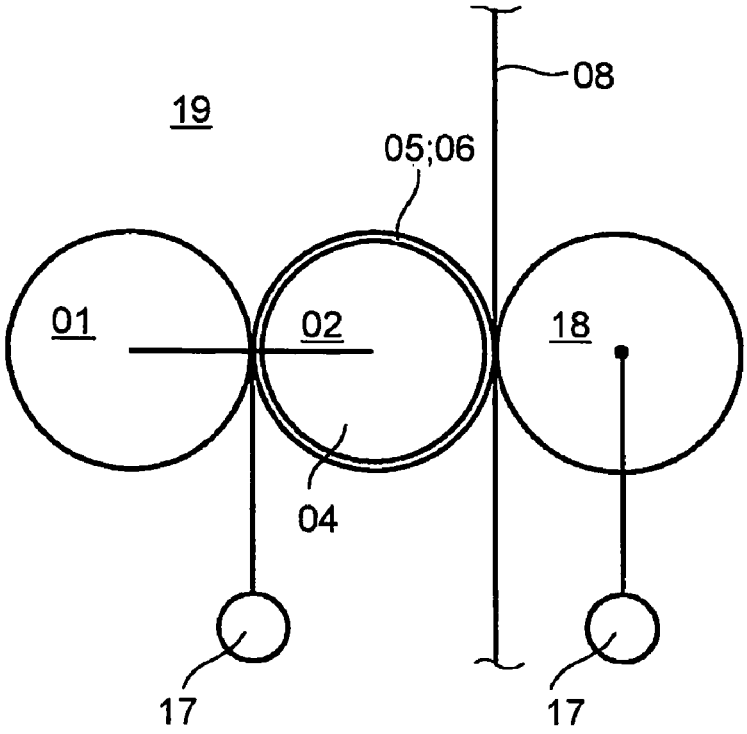
Figure 7:
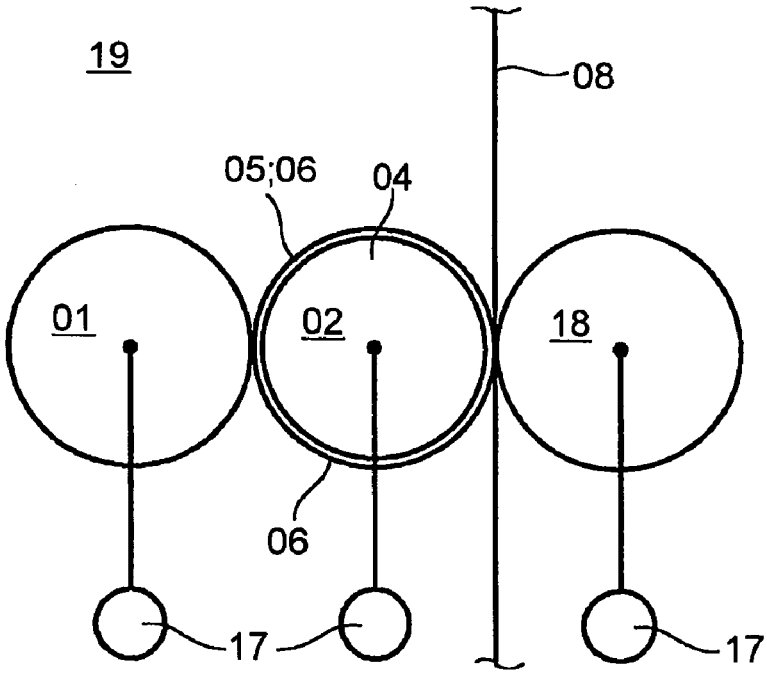

A printing unit 19 in accordance with the present invention is represented in FIGS. 6 and 7, which is either a part of a larger printing unit, for example a five cylinder, nine cylinder or ten cylinder printing unit, or which can be operated as a three cylinder printing unit 19. Here, the transfer cylinder 02 works together with a cylinder 18, which does not convey printing ink, for example a counter-pressure cylinder 18, such as a satellite cylinder 18. Now the "soft" surface of the transfer cylinder 02 works together with the "hard" surface of the forme cylinder 01 on the one side, and with the "hard" surface of the satellite cylinder 18 on the other side. In an embodiment, shown in FIG. 6, where at least the transfer cylinder 02 and the satellite cylinder 18 are driven independently of each other, the one, or several satellite cylinders 18 have their own drive motor 17, while the pair consisting of the forme and transfer cylinders 01, 02 are mechanically coupled and are driven by a common drive motor. Alternatively, the forme and transfer cylinders 01, 02 can be mechanically independent of each other, and each driven by its own drive motor 17, as seen in FIG. 7.

In a first embodiment in FIGS. 6 and 7, the forme cylinder 01, the transfer cylinder 02 and the satellite cylinder 18 are embodied as cylinders 01, 02, 18, each of double circumference, and each with effective diameters $D_{wGZ}$, $D_{wPZ}$, $D_{wSZ}$ of between 260 to 400 mm, and in particular of from 280 to 360 mm. On the surface of the core 04, the transfer cylinder 02 has at least one dressing 05 of a total thickness T of 3.5 to 6.5 mm, and in particular of 3.9 to 5.9 mm. The rise ΔP/ΔS of the spring characteristic, at least in the print-relevant range, as discussed above, lies below 700 (N/cm$^2$)/mm, and in particular lies below 500 (N/cm$^2$)/mm. The forme and transfer cylinders 01, 02, as well as the transfer cylinder 02 and the satellite cylinder 18, have been placed against each other in pairs in such a way that the width B of the contact zone in the position in which they are placed against each other is from 14 to 25 mm, and in particular is from 17 to 21 mm.

In a second embodiment in FIGS. 6 and 7, the forme cylinder 01, the transfer cylinder 02 and the satellite cylinder 18 are embodied as cylinders 01, 02, 18 of single circumference, i.e. each with a circumference of substantially one upright printed page, in particular one newspaper page. They are structured with effective diameters $D^{wGZ}$, $D^{wPZ}$, $D^{wSZ}$ of between 150 to 180 mm, and in particular of between 130 to 170 mm. On the surface of the core 04, the transfer cylinder 02 has at least one dressing 05 of a total thickness T of from 3.5 to 6.5 mm, and in particular of from 3.9 to 5.9 mm. The rise ΔP/ΔS of the spring characteristic, at least in the print-relevant range, as discussed above, again lies below 700 (N/cm$^2$)/mm, and in particular lies below 500 (N/cm$^2$)/mm. The forme and transfer cylinders 01, 02, as well as the transfer cylinder 02 and the satellite cylinder 18, have been placed against each other in pairs in such a way that the width B of the contact zone, in the position in which they are placed against each other, is from 10 to 18 mm, and in particular is from 12 to 15 mm.

The changes implicit because of the greater softness, such as the greater indentation S, the changed roll-off behavior, the larger thickness t or T, and the line must be taken into consideration in the layout of the printing press. For example, a printing press operating with softer and thicker dressings 05, or layers 06, therefore has changed, and in particular has increased cylinder undercuts or roll-off blanket thickness, as well as changed gap dimensions when cylinders are placed against or away from each other due to blanket thickness, or indentation. Also, greater cylinder shift paths are required for the print-off position because of the larger indentation.

The above mentioned dressing 05, or the layer 06, is arranged, for example, in a printing unit with one or with several long, but slim cylinders 01, 02, 14, 16.

Thus, the forme cylinder 01, 16 and the transfer cylinder 02, 14 each have, for example, in the area of their barrels, a length, which corresponds to four or more widths of a printed page, for example a newspaper page. This width may be, for example from 1,100 to 1,800 mm, and in particular may be from 1,500 to 1,700 mm. The diameter $D_{wGZ}$, $D_{wPZ}$ of at least the forme cylinder 01, 16 is, for example, from 145 to 190 mm, and in particular is from 150 to 185 mm, which diameter, in circumference, corresponds substantially to a length of a newspaper page and is thus a "single circumference". The device of the present invention is also advantageous for other circumferences in which a ratio between circumference and length of the cylinder 01, 02, 14, 16, 18 is less than or equal to 0.16, and in particular is less than 0.12, or is even less than or equal to 0.08.

In another embodiment of the printing unit, in accordance with the present invention the length of the barrels of the forme and transfer cylinders 01, 02, 14, 16 is, for example, from 1,850 to 2,400 mm, and in particular is from 1,900 to 2,300 mm, and is dimensioned, in the axial direction, for receiving, for example, at least six side-by-side arranged upright printed pages in broadsheet format. In a variation of the invention, the diameter of at least the forme cylinder 01, 06 lies, for example, between 260 and 340 mm, and in particular lies between 280 to 300 mm, and in another variation for example lies between 290 to 380 mm, and in particular is from 300 to 370 mm, which, in circumference, corresponds substantially to two lengths of a newspaper page and is thus a "double circumference". A ratio of the diameter $D_{wGZ}$, $D_{wPZ}$ of at least the forme cylinder 01, 16 to its length here lies from 0.11 to 0.17, and in particular from 0.13 to 0.16.

While preferred embodiments of a dressing on a cylinder, or a transfer cylinder, as well as printing units of a printing press, in accordance with the present invention, have been set forth fully and completely herein above, it will be apparent to one of skill in the art that various changes in, for example the dressing material, the mechanisms used to secure the dressings to a cylinder, and the like could be made without departing from the true spirit and scope of the present invention, which is accordingly to be limited only by the following claims.

What is claimed is:

1. A printing blanket adapted to be placed on a surface of a cylinder in a printing press, said printing blanket comprising:

an incompressible, inelastic support layer;

an elastic, compressible upper layer secured to said incompressible, inelastic support layer, said elastic, compressible layer having a thickness of at least 3.0 mm, said elastic, compressible layer exhibiting a contact pressure in response to a deformation of said elastic, compressible layer, a spring characteristic of said elastic, compressible layer, which is expressed as a ratio of a change in said contact pressure to a change in said deformation of said elastic compressible layer, being less than 700 $(N/cm^2)/mm$ in a range of an operating pressure for said contact pressure from 80 to 180 $N/cm^2$ and in a range of said deformation from 0.22 mm to 0.38 mm.

2. The printing blanket of claim 1 wherein, in use of said printing blanket in wet offset printing, a range for said operating pressure is from 80 to 100 $N/cm^2$.

3. The printing blanket of claim 1 wherein, in use of said printing blanket in dry offset printing, a range of said operating pressure is from 120 to 180 $N/cm^2$.

4. The printing blanket of claim 1 further including means releasably securing said printing blanket on a surface of a cylinder.

5. The printing blanket of claim 1 wherein said printing blanket has a thickness of at least 3.5 mm.

6. The printing blanket of claim 1 wherein said printing blanket has a width, in an axial direction of the cylinder, of six widths of a printed page in newspaper format.

7. The printing blanket of claim 1 wherein said elastic, compressible layer is adapted to contact a web of material to be imprinted.

8. The printing blanket of claim 1 wherein said incompressible, inelastic support layer is a dimensionally-stable metal support layer.

9. The printing blanket of claim 8 wherein said metal support layer is sheet metal.

10. The printing blanket of claim 1 wherein said printing blanket is adapted for use in a printing group of a printing press which prints printed pages in newspaper format.

* * * * *